US010036197B1

(12) United States Patent
Betts-Lacroix et al.

(10) Patent No.: US 10,036,197 B1
(45) Date of Patent: Jul. 31, 2018

(54) DEVICE, SYSTEM AND METHOD OF INTERCONNECTING DOORWAYS

(71) Applicant: Vium, Inc, San Mateo, CA (US)

(72) Inventors: Jonathan Betts-Lacroix, Menlo Park, CA (US); Kevin Harada, San Mateo, CA (US); Alson Kemp, Burlingame, CA (US)

(73) Assignee: Vium, Inc., San Mateo, CA (US)

( * ) Notice: Subject to any disclaimer, the term of this patent is extended or adjusted under 35 U.S.C. 154(b) by 206 days.

(21) Appl. No.: 14/986,586

(22) Filed: Dec. 31, 2015

(51) Int. Cl.
*E06B 7/18* (2006.01)
*E06B 7/16* (2006.01)
*E04B 1/66* (2006.01)

(52) U.S. Cl.
CPC ..... *E06B 7/16* (2013.01); *E04B 1/665* (2013.01)

(58) Field of Classification Search
CPC ..... E06B 7/16; E04B 1/665
USPC ..... 49/498.1, 477.1, 506
See application file for complete search history.

(56) References Cited

U.S. PATENT DOCUMENTS 5,295,522 A * 3/1994 DeAngelis ..... H01L 21/67376 141/286
6,010,133 A * 1/2000 Boyd ..... H01J 37/18 277/312
6,883,539 B2 * 4/2005 Inoue ..... H01L 21/67772 137/565.23
7,203,563 B2 * 4/2007 Chang ..... H01L 21/67017 700/112
8,171,964 B2 * 5/2012 Okabe ..... H01L 21/67373 141/63
9,281,223 B2 * 3/2016 Hara ..... H01L 21/67772
9,406,537 B2 * 8/2016 Oyama ..... H01L 21/67373
2007/0080096 A1 * 4/2007 Miyajima ..... H01L 21/67126 206/710

* cited by examiner

*Primary Examiner* — Jerry E Redman
(74) *Attorney, Agent, or Firm* — Kim Rubin

(57) ABSTRACT

A doorway interconnection and method of creating an airtight seal between two doorways includes a first temporary membrane creating an airtight seal on a first doorway and a second temporary membrane creating an airtight seal on a second doorway and a gasket between the two doorways, and vents and valves to place and remove a sterilizing fluid in the inter-doorway volume. Such a system may be used to attach a sterile modular building unit to a sterile facility without losing the sterility of either the facility or the module building unit. Access to the membranes may be from one direction only. The gasket may provide motion and sound isolation between. Additional elements limit relative motions between the first and second doorways.

15 Claims, 6 Drawing Sheets

CROSS-SECTION A-A

CROSS-SECTION A-A

VIEW THROUGH DOORWAY

DEVICE, SYSTEM AND METHOD OF INTERCONNECTING DOORWAYS

BACKGROUND OF THE INVENTION

One method of creating a modular sterile facility is to interconnect pre-made modular units. In order to maintain both the operating facility and a newly-added pod in a sterile condition it is necessary to have a junction between the operating facility and the modular units so adapted that they may be connected and disconnected without allowing outside, unsterile air to enter. Prior art does not meet this requirement.

SUMMARY OF THE INVENTION

Embodiments provide for devices, methods and systems of interconnecting one sterile building pod to another. Another name for pod is module. Each pod has a doorway, which is initially sealed with a membrane so as to maintain the interior of the pod sterile. A new pod is positioned next to an existing pod so that a doorway on each are proximal, facing each other, and aligned. A flexible gasket is placed between the two doorways, creating a volume inside the gasket, between the two membranes. This volume is sterilized, and then the two membranes are removed, creating a through passage through the two doorways between the existing and new pods.

In one embodiment the gasket is inflatable and inflated to seal volume created.

In one embodiment the gasket has one or more penetrations or manifolds to permit a sterilizing fluid to be blown or pumped into the volume.

In one embodiment the membranes are accessible from the inside of the existing pod and from the outside of the new pod.

In one embodiment, the gasket isolates the two pods from noise and vibration.

In one embodiment, the gasket isolates the two pods against motions due to earthquakes.

In one embodiment one or more mechanical restraints are between the two pods, around the perimeter of the two doorways, wherein the restraints provide a first level of movement freedom within a first range of relative motion between the two pods, and provide a second level of movement freedom beyond the first range of relative motion. The first range may be substantial freedom of movement, limited primarily by flexing of the gasket. The second range may be substantially rigid, preventing the flexible gasket from damage and protecting the junction between the doorways from opening such that the sterile seal is broken. In this second range, movement of one pod is coupled to the other pod.

The membranes may be single-use or reusable. They may be attached, or removed, or both, without any tools or without specialized tools.

DETAILED DESCRIPTION

All descriptions, embodiments, drawings, and examples are non-limiting.

Figure 1:
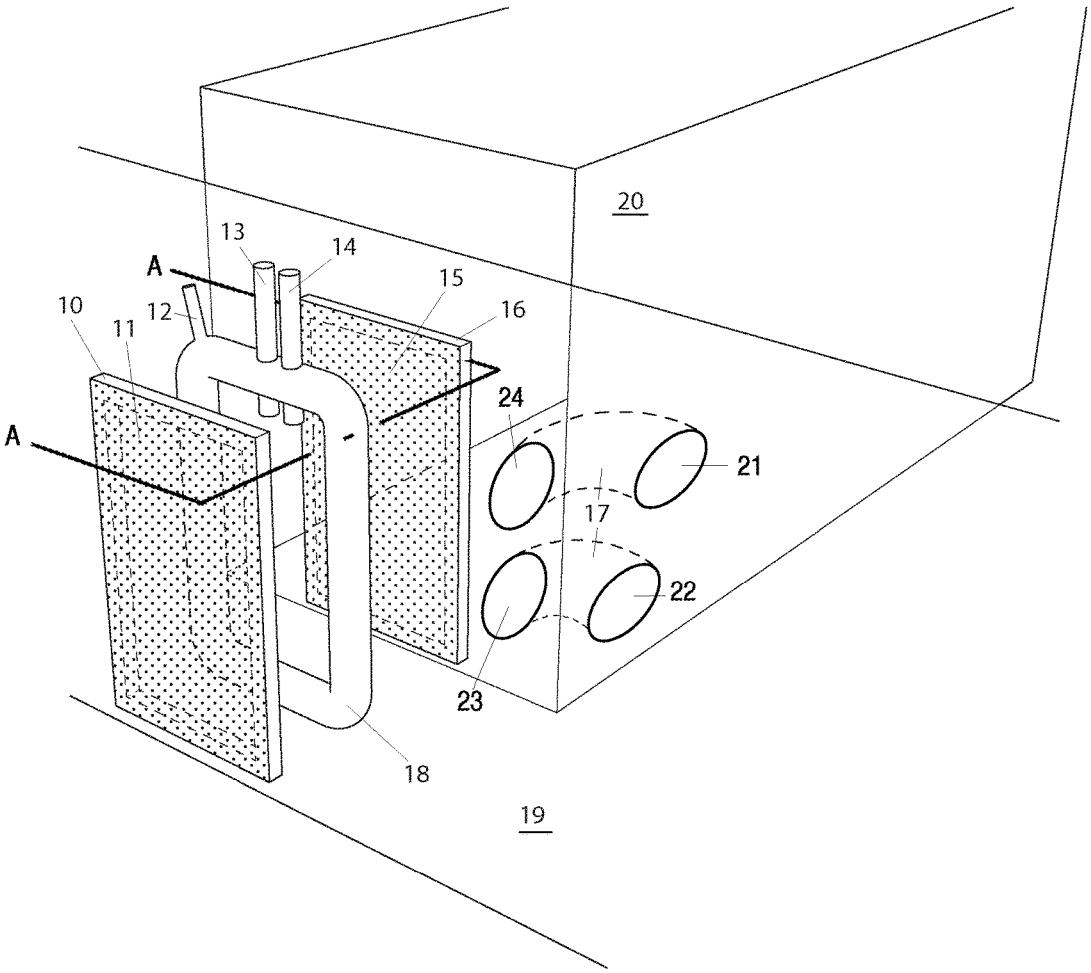
FIG. 1 shows an exemplary configuration of an existing pod, a new pod, doorway membranes and a flexible gasket.

Turning now to FIG. 1, we see a doorway 10 in an existing pod, 19, and a doorway 16 in a new pod 20. Another name for pod is module. Although it is convenient to refer to an "existing pod," or an interconnection of existing pods, nominally fixed (although not permanently fixed to a location), and to a "new pod," which is typically being moved into position and being connected to the existing pod, indeed such names are arbitrary and non-limiting. For example, both pods may be "new." Both pods may be movable and being positioned as part an embodiment method. Both pods may be "existing" and the devices, systems and methods of this invention may be used for purposes, such as maintenance, adjustment, reconfiguration and the like. An addition, similar processes are used, in reverse, to remove a pod while maintaining sterility for either one or both pods. Such removal methods, devices and systems are explicitly claimed.

In one embodiment, the existing pod 19 is part of an operating sterile environment such as a vivarium. The new pod 20 is being added to expand the environment. The new pod is mechanically positioned so that the doorway 16 on the new pod 20 is aligned with, opposite, and proximal to the doorway 10 on the existing pod 19. Then, a flexible gasket 18 is placed between the two doorways 10 and 16. In one embodiment the gasket 18 is already attached to either the existing or new pod.

In one embodiment, the gasket 18 is inflatable, somewhat like an inner tube, via valve 12 or fluid intake manifold 13. In other embodiments the gasket is flexible but not inflatable, such as a comprising a foam material. In yet another embodiment, the gasket is in configured as one or more bellows, or comprises z-fold surfaces.

In one embodiment, a membrane 11 is used across the doorway 10 of the existing pod 19. This membrane 11 serves to maintain the sterile environment inside existing pod 19. In one embodiment, a membrane 15 is used across the doorway 16 of the new pod 20. This membrane 15 serves to maintain the sterile environment inside new pod 20.

In one embodiment, membrane 11 is accessible from the direction of the interior of the existing pod 19. In one embodiment, membranes 15 is accessible from the outside of the new pod 20, when the new pod 20 is free standing. Thus, membrane 15 is accessible from the inside of the existing pod 19, once the two pods are interconnected and membrane 11 is removed.

When the gasket is inflated, it forms a seal between the existing pod 19 and the new pod 20. A volume, the "inter-pod volume," is created, where a portion of that volumetric perimeter comprises the membrane sealing the doorway of the existing pod, the membrane sealing the doorway of the new pod, and the gasket. This inter-pod volume is not shown explicitly in FIG. 1 because the existing and new pod are not yet, as shown, in proximal alignment. In some embodiments, sterile fluid is blown or pumped into this volume. Fluid manifold 13 may be used for this purpose. In some embodiments the sterile fluid is then removed. Fluid manifold 14 may be used for this purpose. Sterilizing fluids may be a gas, an aerosol, a liquid, or any combination. Such sterilizing gases and aerosols are well known in the art. A sterilizing fluid may be bleach, as a non-limiting example. A sterilizing liquid may be liquid nitrogen, as a non-limiting example. "Sterile" and "sterilize" have the construction herein as used in the art for operating vivariums.

Continuing with an installation method or process, the membrane 11 sealing the doorway 10 of the existing pod 19 is then removed. This may be removed manually, possibly without specialized tools, from inside the existing pod One removed, the previous inter-pod volume is accessible freely from the existing pod 19. From the interior of the existing pod 19, via the inter-pod volume, the membrane 15 sealing the new pod 20 is removed. Now, the interior of the existing pod and the interior of the new pod are connected, without voiding any previous sterility of the interiors of the existing pod 19 or the new pod 20.

Continuing with FIG. 1, 17 shows an alternative embodiment of sterilizing fluid manifolds 13 and 14. In this embodiment the manifold runs along the side of the doorway 16, or through the doorway 16, or through the membrane 15, but does not penetrate the gasket. The one or two manifolds route through pod 20 and terminate at the outside of the pod 21 and 22. The manifold ends terminate inside the inter-pod volume are shown 24 and 23. In yet another embodiment the manifold ends terminate inside of pod 20.

The process in reverse is (1) place membrane 15 on doorway 16; (2) place membrane 11 on doorway 10; and then (3) separate pod 20 from pod 19.

Membranes 11 and 15 may be single-use or may be re-used. Gasket 28 may be single-use or may be re-used.

It is sometimes desirable to isolate the pods for noise and vibration. In some embodiments, the gasket 18 also provides noise and vibration isolation between pods.

It is sometimes desirable to isolate the pods for motion causes by earthquakes or other sources, including nearby activity or ground settlement. In some embodiments, the gasket 18 also provides such motion isolation.

Figure 2:
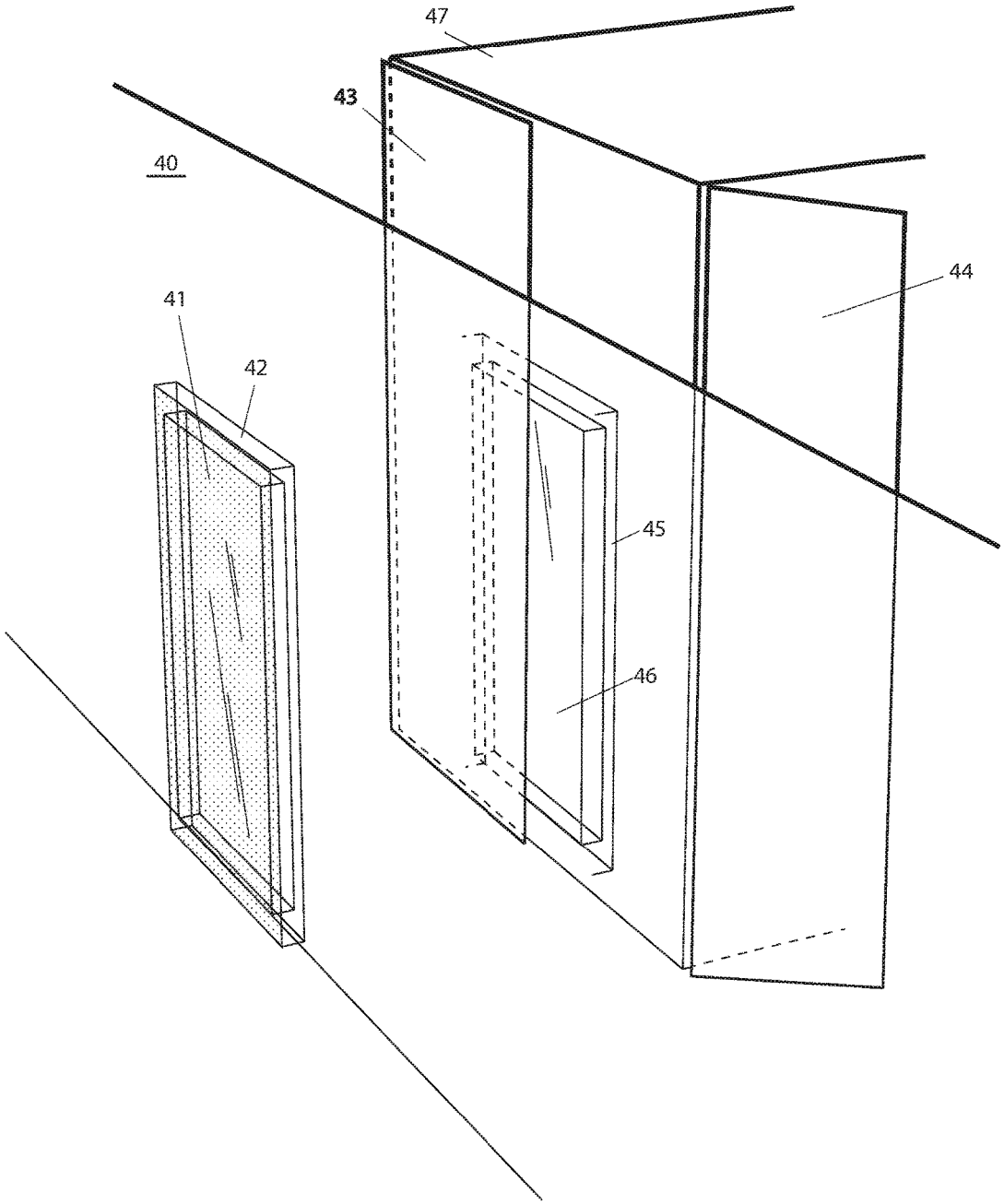
FIG. 2 shows an alternative view of an existing pod, a new pod, doorway membranes and a flexible gasket.

Turning now to FIG. 2 we see an alternative view of pods, doorways and membranes. In FIG. 2 a flexible gasket is not shown for clarity. The existing pod or structure is 40. The new pod or structure is 47. In this figure we see two possible doors 43 and 44 for pod 47. Such doors may be on a standard shipping container, which has been adapted to be pod 47, for example. In this Figure, door 44 is folded back while door 43 is in its closed position. Doors 43 and 44 may be closed to safely protect doorway 45 and membrane 46 while in transit; and then opened for interconnecting pod 47 to an existing pod or structure 40. In this Figure, membranes 41 and 46 are accessible as described above for FIG. 1, however, they are shown as being "interior" to their respective doorframes 42 and 45. That is, membranes may be on a surface of a doorframe or in the interior of the doorframe, or in another locations. Doors or other protection elements are not shown. Such protection elements are appropriate when the doorway is not interconnected. Such removable or operable protection, including a sliding door, hinged door or doors, z-fold doors, rolling doors, shipping container doors or a flexible flap may be used for this purpose. Such a removable element or operable doors are explicitly claimed, along with the doorways 42 being pre-existing on the existing pod 40.

Membranes may comprise a plastic sheet, such as polyethylene terephthalate, polyethylene, polypropylene or other plastic. Membranes may comprise a rubber sheet, treated paper, or other material. A membrane need not be gas impermeable, however, it must be impermeable to contaminants to a vivarium sterile environment, such as bacteria. A membrane may or may not have a strengthening perimeter.

A suitable material for attaching membranes is an adhesive, which may either be permanent or removable. Examples of a removable adhesives include rubber cement, caulk, wax, and the adhesive used to attach pull-tabs to soft-drink cans. Adhesives may be removed mechanically, cut, dissolved, or removed or separated by other means. Gaskets or sealants may be used in addition to an adhesive or other attachment means. Another attachment means is hook and loop fasteners. Yet another attachment means is a zipper. Yet another attachment means is snaps. Yet another attachment means is a ridge in a receptacle slot, such as used in common sandwich household storage bags. Yet another attachments means is static, such as used for common car window stickers. Yet another attachment means is a film adhesive such as commonly used for glass tinting films. Yet another attachment means is to place the edge of the membrane within a flap secured to the doorframe or pod opening. Adhesives may be cured by the use of heat, cooling, visible light, UV light, or other radiation. Adhesives may be cured by time or by exposure to air or to a chemical hardener. Adhesives may have two components, such as used by epoxies and some polymers. Membranes may be attached without the use of specialized tools or without the use of any tools. Membranes may be removed without the use of specialized tools or without the use of any tools. New membranes may be on a roll. Portions of membranes, or some or all of a membrane attachment mating element may be 3D printed.

Both membranes may be accessible only from the direction that is inside of pod 40. That is, membrane 46 is accessible only from outside of pod 47 when pod 47 is not proximal to a blocking object, such as pod 40. In another embodiment one or both membranes are accessible from both inside and outside their respective pods. In one embodiment membrane 46 is accessible from only inside of pod 47.

Figure 3:
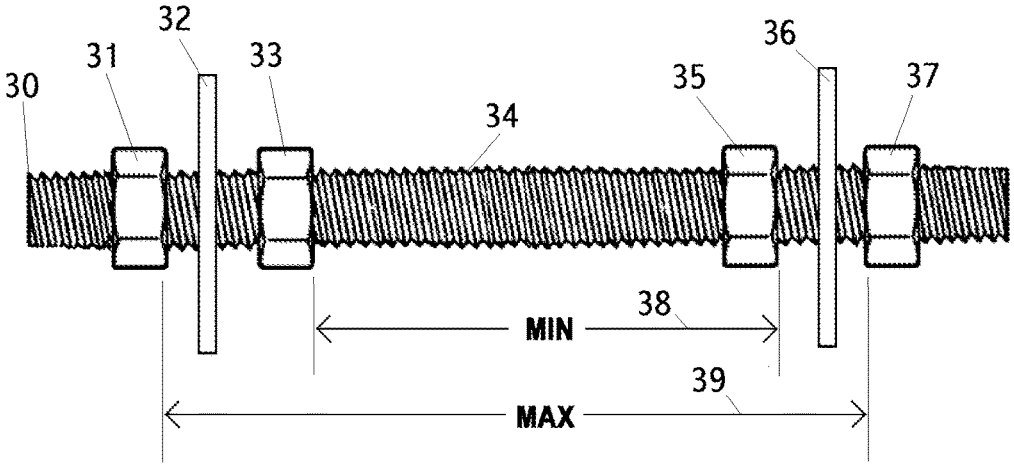
FIG. 3 shows an exemplary configuration of a motion restraint for use between two pods.

Turning now to FIG. 3, we see an embodiment of a device to protect pods, gaskets, and inter-pod volumes from damage in the event of large motions, such as from earthquake, Although it may be desirable to isolate pods against relatively small motions from earthquakes or other sources, it may also be desirable to protect the junction between pods from damage or the seal from voiding due to larger motions. Therefore, is some embodiments, the relative motion between the pods is limited, if past a first range of relative motion. Such motion ranges may be measured in multiple axes and may also be ranges in force, rather than ranges in distance, but still we call these "relative motion."

Referring to FIG. 3, we see one embodiment of a portion of a device to provide such motion limiting. Here, one or more rods 34 is placed between the two pods. For example, rods may be placed around the perimeters of the doorways, or at or near structural points in the pods. The number of rods may be 1, 2, 3, 4, 5, 6, 7, 8, 9, 12 or another number. Rods may or may not be threaded. Elements 32 and 36 in the Figure represent either the walls or structure of the existing and new pods respectively, or represent mechanical elements that in turn are mechanically attached to the pods. Such attachment may be rigid or may have some spring, such as the use of spring-steel straps. Elements 32 and 36 have some freedom of movement on the rod, 34. Note that gaskets or other sealing may be used between the rod 34 and elements 32 and 36 so that sterility may be preserved inside of the pods. The rod is shown in FIG. 3 with four nuts or other physical restraints, 31, 33, 35 and 37. Element 32 is restrained to move along rod 34 between restrains 31 and 33. Element 36 is restrained to move along rod 34 between restrains 35 and 37. Thus, the relative free movement between the two pod is thus constrained to a minimum distance shown as MIN, 38 and a maximum distance, MAX, 39. Note that such movement may not be completely "free," due to limitations imposed by the flexible gasket, constraints or friction of the elements of this device and other elements of the configuration of the pods. When movement or forces are beyond the MAX distance 39, or less than the MIN distance 38, the relative movements of the two pods are coupled. This prevents damage to the flexible gasket, which may have working range between the MIN and MAX distance, and prevent voiding the seal created by the gasket. Note that other devices, considerably different in configuration or design may provide a similar function of constraining forces or relative distances between the two pods so as to prevent damage to the gasket or a seal void.

Continuing with FIG. 3, the rod 34 and other elements of this Figure may be put in place after the new pod is moved in place near the existing module, or they may be part of, or attached to, either or both of the pods. The elements in FIG. 3 may be viewed as one embodiment of a pod-to-pod motion restraint or limiter. Note that in the configuration shown in the Figure, the rod 34 may be inserted through holes in the structure of the containers, 32 and 36, or in attached elements 32 and 36, after the new pod is in place. Nuts or restraints 33 and 35 may be positioned on rod 34 after the two pods are positioned. Any fraction or all of the nuts or other restraints 31 and 37 may be put in place after the rod 34 is place. In this way, the locations of all or a portion of nuts or restraints 31, 33, 35, and 37 may be set responsive to the specific needs and the specific locations and configurations of the two pods.

Figure 4:
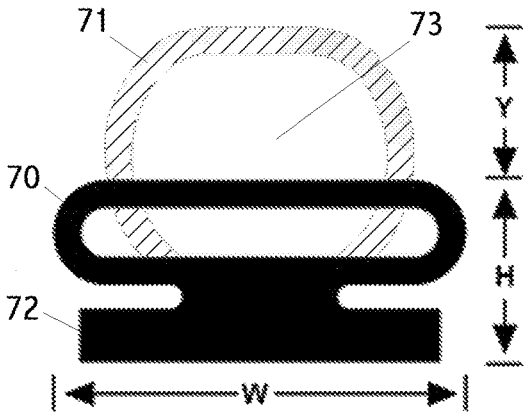
FIG. 4 shows an exemplary cross-section of an inflatable gasket.

Turning now to FIG. 4, we see one embodiment of a cross-section of a gasket. Here, the gasket is an inflatable air bladder. 70 shows a cross-section of the air bladder deflated. 71 shows a cross-section of the air bladder inflated. 73 shows the interior of the air bladder when inflated. 72 shows a base of the air bladder, which may be used to attach the air bladder to a surfaces, such as a doorway, or an area on a pod surrounding a doorway, or on an intermediate mounting surface or structure. Base or pad 72 may also be used as a "bumper" to protect the seal from damage or voiding a sterile seal when two pods sealed by the gasket move towards each other. Such use of 72 as a bumper creates an effective minimum distance that the two pods may move towards each other. Such a minimum distance, in this embodiment, is approximately H as shown in FIG. 4, or somewhat less than H, not counting mounting surfaces or structures for the gasket. In FIG. 4, W is the width of air bladder in cross-section. H is the effective thickness of the air bladder when deflated. Y is the additional thickness of the air bladder when inflated. In FIG. 4, one pod (not shown) would be below the air bladder and the other pod (not shown) would be above the air bladder. The air bladder might be attached via its base 72 to the pod that would be below the air bladder as shown in FIG. 4.

Suitable air bladders, or portions of air bladders, are made by Dynamic Rubber Inc of Des Plaines, Ill. and by Pawling Engineered Products of Pawling, N.Y.

Figure 5A:
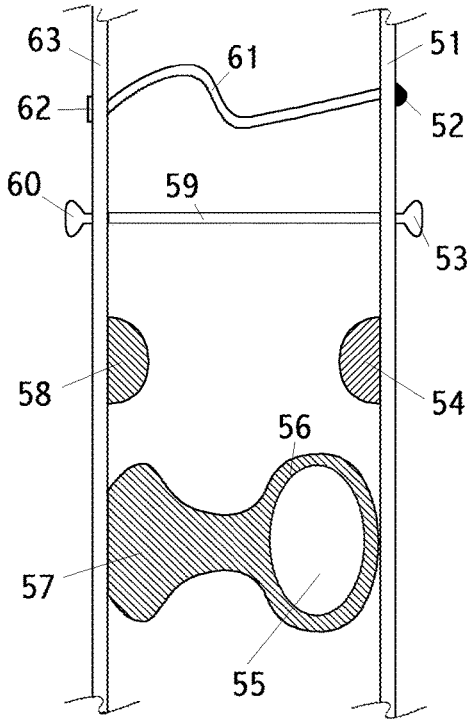
FIG. 5A shows several alternative motion restraint embodiments.

Turning now to FIG. 5A we see several alternative embodiments to the pod-to-pod movement restraint shown in FIG. 3. 51 and 63 are the ends, sides, bodies or structurally attached element(s) of, or to two pods, an "exiting pod" and a "new pod" respectively. Note again that the terms "existing" and "new" are arbitrary for convenience of discussion. In fact, either or both pods may be existing or new, or fixed or mobile. 61 is a slack web, rope, or flexible material, or jointed elements. The ends of web 61 are secured, directly or indirectly, to pod structures 51 and 63 at ends shown 52 and 62 respectively. If or when pods 51 and 63 move away from each other, web 61 becomes taught and limits this relative pod-to-pod motion. Suitable material for web 61 is cloth, plastic, metal or other material. The web may be woven or non-woven; it may be braided or twisted or neither. It may be rigid or non-rigid; it may be constructed of a single band or strand, or from many bands or strands. It may comprise one or more rigid elements and one or more joints between the one or more rigid elements or between the one or more rigid elements and one or both pods 51 and 63. For example, ends 52 and 62 may or may not be joints.

An alternative embodiment to limit pod-to-pod motion is shown in FIG. 5A as rod 59 with ends 53 and 60 preventing the rod from pulling through structural elements 51 and 63, part of or attached to the two pods. Ends 53 and 60 may be elongate and pass through elongate holes in 51 and 63, then rod 59 is rotated to effectively secure ends 53 and 60 from passing back through the elongate holes. Many other configurations and embodiments are possible. Non-limiting examples include: bolts, nuts, heads, pins and angles.

Embodiment elements 61 and 59 limit relative motion of the two pods away from each other. Elements 54, 58 and 57 limit relative motion of the two pods towards each other. 58 and 54 may be called "bumpers." There may be two as shown, or there may be only one. Bumpers may be made out of rubber, plastic, steel, aluminum or another material. They may be solid or hollow. They may be monolithic or comprised of multiple elements. A bumper may comprise or be composed of one or more springs in any form, including coil, leaf, and hydraulic.

A bumper may be integral to the gasket, 56. Here, gasket 56 is shown inflated with a gasket interior of 55. The gasket has a gasket base, 57, which may be used to attach the gasket 56 either directly or indirectly to pod or pod structural element 63. Another gasket base is shown in FIG. 4 as 72. Restraint or limit of relative pod-to-pod motion with the pods moving away from each other, such as accomplished by elements 61 or 59, may also be alternatively integral to the gasket 56. For example, gasket 56 may be structurally attached to pod or pod structural element 51. As pods 63 and 51 move apart, gasket 56 may stretch or change shape, ultimately compressing the interior 55, and limit pod-to-pod motions. Elements such as 61, 59, 58 and 54 may be placed in any number between pods 51 and 63. Suitable numbers of elements are 1, 2, 3, 4, 5, 6, 7, 8, 9, 10, 12 and other numbers. They may be placed on the doorframes, around the perimeters of doorframes, or in another location. They may be placed within a doorframe or doorway, although this is not a preferred embodiment.

Figure 5B:
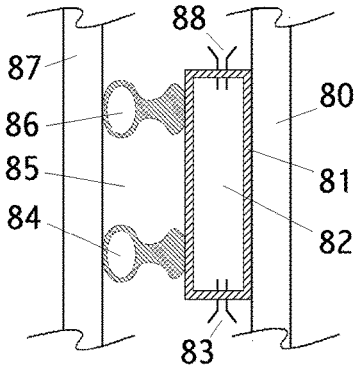
FIG. 5B shows an alternative method of mounting a gasket and providing sterilization manifolds.

Turning now to FIG. 5B we see an alternative embodiment of a way to attach a gasket to a pod or place a gasket between two pods. Here, two pods or structural elements of two pods are shown 80 and 87 respectively. An annular structure, such as a box or U-channel in cross-section, is shown 81. One embodiment of the annular structure is to use U-channels, which might be welded at mitered corners, for example. The open end of each U-channel element might face inward to the annular structure, or outward, or some other arrangement. 85 is the inter-pod volume. As the annular structure 81 is open to the interior, the volume within the structure 82 is open to volume 85. Thus, volume 82 is really part of the total inter-pod volume. Structure 81 is attached to pod 80. Gasket 84 is placed or affixed, temporarily or permanently, against structure 81. Note that 84 shows the gasket in cross-section. The same gasket is shown as 86, since there are two gasket cross-sections, one below the doorway opening and one above the doorway opening (or equivalently, left and right of the doorway opening). 88 and 83 show two fluid manifolds for inserting and removing a sterilizing fluid into the inter-pod volume 85. Only one manifold may be used. Structure 81 may be, or may also be a membrane support surface.

Figure 5C:
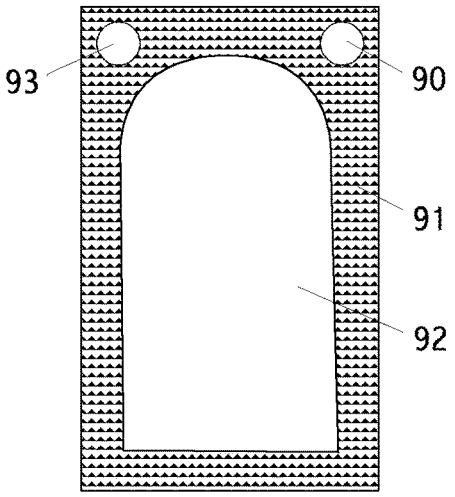
FIG. 5C shows an alternative configuration of sterilization manifolds.
Figure 6:
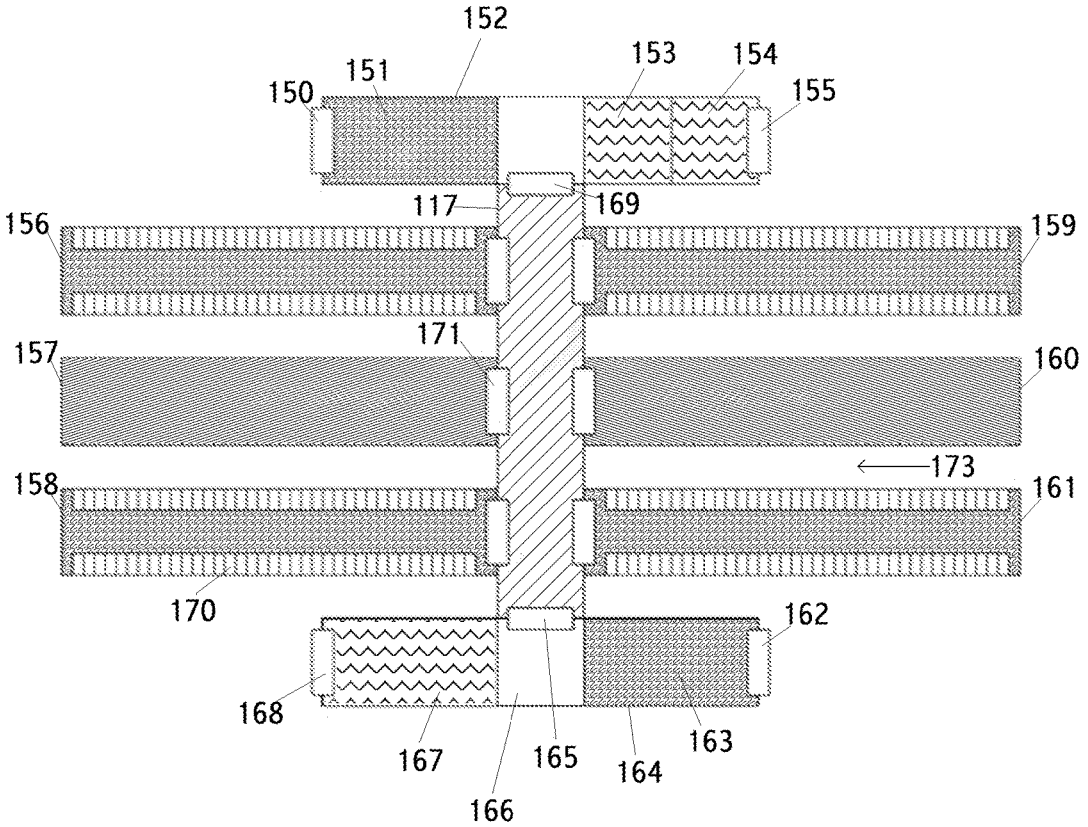
FIG. 6 shows an embodiment of a modular vivarium.

Turning now to FIG. 5C we see yet another embodiment of the configuration of fluid manifolds. Here, the view is through a doorway with 91 being a doorframe or similar element. The doorway is shown as 92. 90 and 93 show the ends of two fluid manifolds for inserting and removing a sterilizing fluid into the inter-pod volume, not shown. Only one manifold may be used. The view in this FIG. 5C may be from the inside of the inter-pod volume looking towards the interior of a pod or maybe from the interior of a pod looking towards the inter-pod volume.

Turning now to FIG. 7, we see an exemplary configuration of pods in a modular vivarium. Nine pods in five pod types are shown. The "spine" of the configuration is one hallway pod 172. At one end of the hallway pod 172 is an ingress pod 152, connected to the hallway pod at doorway junction 169. At another end of the hallway pod 172 is an egress pod 164, connected to the hallway pod at doorway junction 165. Three spur pods are shown on each side of the hallway pod 172: four cage-rack pods 156, 158, 159 and 161; and two HVACPIT pods 157 and 160. These connect to the hallway pod at doorway junctions. One such doorway junction has reference designator 171: between HVACPIT pod 157 and the hallway pod.

In one embodiment, ingress pod 152 provides for ingress of people at doorway 155, with a gown-in area 154 and an air shower area 153. Ingress pod 152 may have a supplies-in doorway 150 and a clean storage area 151. Both people and equipment from the ingress pod 152 may move into the hallway pod 172 through doorway junction 169. Embodiments include the relative arrangement shown of any subset of these elements.

In one embodiment, egress pod 164 provides for egress of people and waste at doorway 168, with a procedure and surgery suite 163 and equipment access at doorway 162. Area 167 may be used for de-gown and dirty storage. Doorway junction 165 is use for people exit and for two-way animal and equipment movement from and to the hallway pod 172 and staging area 66. Embodiments include the relative arrangement shown of any subset of these elements.

Cage-rack pods 156, 158, 159 and 161 may have animal cages in racks 170 where the racks are arranged in two rows along the interior sides of the pod, such as pod 158. Cages in racks may be accessed by an automated cage placement and retrieval device that operates down the corridor of the pod between the rows of cage racks. The automated cage placement and retrieval device may pick up and deliver animal cages at a doorway junction, such as 171 with the hallway pod 172.

A procedure station, not shown in the Figure, may be mobile within the hallway pod 172, and align with the spur pod doorway junctions, such as 171, and be configured to accept a cage from or deliver a cage to the automated cage placement and retrieval device.

The procedure station may mate with the doorway junction, such as 171, such that air flow from the spur pod, such as 157, through the procedure station, and air flow from the hallway pod interior through the procedure station, and then both airflows exhaust through an exhaust port in the procedure station, such that gases and potential contaminants in the procedure station do not enter or contaminate the air of either the spur pod or the hallway pod.

Pods may be constructed from standard shipping containers. HVAC, power and IT components in the HVACPIT pods may be industry standard components, rather that expensive, specialized high-reliability components of vivarium prior art. Cage-rack and other pods may have their interiors powder-coated. Some permanent components of pods, such as cage racks, may be installed prior to powder-coating and powder-coating at the same time as the pod interior.

Access space 173 between spur pods may or may not exist. That is, spur pods may be effectively adjacent to each other. Or, a service gap may be present, as shown in the Figure.

Pods may be supported on adjustable feet or supports that may raise and lower the pod to align with other pods, and may level the pod to align with other pods. Pods may be supported on vibration, noise, shock or earthquake isolation feet or support. The feet or supports for raising, lower, and leveling may be the same feet or supports for vibration, noise, shock or earthquake isolation. Such supports may be inflatable. Additional such supports may be used for redundant support.

Pods may be moved into position and aligned using X-Y movable shuttles, whereby shuttle we mean any piece of transport equipment so adapted, whether controlled manual or automatically, and whether powered or unpowered.

Methods of attachment for membranes include but are not limited to:

- removable adhesive, such as used on soda can pull-tabs;
- magnetic gasket, such as used on refrigerator doors;
- free magnets in conjunction with a flexible gasket;
- hook and loop fastener in conjunction with a flexible gasket;
- long, thin clamps, similar to binder clips, in conjunction with a flexible gasket;
- adhesive such as used on window films to attach to glass;
- static attachment, such as used for vinyl decals on glass
- ridge in pocket, such as used to seal sandwich bags;
- zipper, such as used to close scuba diving dry suits;
- caulk;
- heat-shrinkable film (placed around a rim, then shrunk tight);
- other.

A membrane material may be gas impermeable.

A membrane support surface may be stainless steel, glass, hard plastic (PVC, etc.) or other material. It may be attached to the pod doorways with permanent caulk or other adhesive. The purpose of the membrane support element is to create a smooth, uniform surface of known characteristics, unlike the doorway of a shipping container. The membrane support surface may be little more than a flat, open rectangle, a "picture frame," glued to the container around the doorway.

Note that inter-pod volumes may be small or large. In one embodiment, the volume should be as small as possible while permitting gaskets and pod-to-pod motion restraints to be placed and be functional as described herein. Such minimization limits wasted space within a modular vivarium plan and minimized pod-to-pod transit. However, the inter-pod volume may also be so large as to be considered a passageway, hall or hallway. Doors, doorways and doorframes are not necessarily rectangular. Note, for example, the door opening 92 in FIG. 5C is not rectangular. Inter-pod volume may be used for another purpose, such as providing HVAC connection, power connection, IT connections, air showers, monitoring sensors, or other purposes. In one embodiment, HVAC ducting from the HVACPIT module connects to the modular vivarium, at least in part, through the inter-pod volume. Elements such as gaskets in any Figure and the frame 88 in FIG. 5B may comprise HVAC, power, or IT connections. Elements 90 and 93 in FIG. 5C may alternatively or additionally be ducts or conduits for HVAC, power or IT connections.

"Inside a doorway" may mean either from the interior of a doorframe, similar to the common meaning of "standing in a doorway," or may mean the inside of a building or module comprising the doorway. "Outside a doorway" may mean either not the interior of a doorframe, similar to the common meaning of "not standing in a doorway," or may mean on the outside of a building or module comprising the doorway.

The terms "fixed" and "movable," and the terms "existing" and "new" as applied to doorways, doorframes, buildings and modules are arbitrary unless stated otherwise, and are used for clarity only. All doorways, doorframes, buildings and modules may be any combination of "fixed," "movable," "existing" and "new."

The term "baffle" includes but is not limited to an accordion configuration. One non-limiting example of a baffle is a light-tight baffle between a moving lens (for focus) and a camera body. Another non-limiting example of a baffle is the pliant baffle between the two rigid bodies of an articulated bus. Yet another non-limiting example of a baffle is the baffle on a bellows.

The "axis of an annulus" is a line perpendicular to the plane of the annulus. For a pliable annulus, the axis of the annulus is along the primary direction of baffle pliability.

In most instances, the "inter-pod volume" of this specification is the same or predominantly the same as the "inter-doorway volume" in the claims, when the doorways are used for or are part of pods.

"Limiting relative motion" between two pods or two doorways may mean "preventing" such motion or may mean limiting such relative motion to significantly less motion per unit of force that than is permitted when such relative motion is not so limited. For example, one might consider a pliable annulus or gasket as having a first spring constant for its normal operating range and the embodiments of this invention having a second spring constant for pod-to-pod (or doorway-to-doorway) distances less than a desired minimum distance and greater than a desired maximum distance. The second spring constant is substantially higher than the first spring constant. Substantially higher means at least a factor of 5, 10, 50, 100, 500, 1000 or 5000. The second spring constant may be "substantially rigid." Normal operating range of the pliable annulus or gasket being the normal day-to-day motions caused by temperature, movement of people and equipment, movement of nearby traffic, normal settling, normal ground heave, wind, vibration, and common noise.

"Flexible" and "pliable" are equivalent terms.

Specifically claimed as embodiments are all combinations of claims, features embodiments and drawings relating to door interconnections used in modular vivariums, modules for vivariums, and methods of constructing, modifying, expanding, maintaining, and removing modular vivariums and modules for vivariums. Doors, doorways, door frames or doorway interconnections may be used for, with, or in vivarium modules.

Ideal, Ideally, Optimum and Preferred—Use of the words, "ideal," "ideally," "optimum," "optimum," "should" and "preferred," when used in the context of describing this invention, refer specifically a best mode for one or more embodiments for one or more applications of this invention. Such best modes are non-limiting, and may not be the best mode for all embodiments, applications, or implementation technologies, as one trained in the art will appreciate.

All examples are sample embodiments. In particular, the phrase "invention" should be interpreted under all conditions to mean, "an embodiment of this invention." Examples, scenarios, and drawings are non-limiting. The only limitations of this invention are in the claims.

May, Could, Option, Mode, Alternative and Feature—Use of the words, "may," "could," "option," "optional," "mode," "alternative," "typical," "ideal," and "feature," when used in the context of describing this invention, refer specifically to various embodiments of this invention. Described benefits refer only to those embodiments that provide that benefit. All descriptions herein are non-limiting, as one trained in the art appreciates.

Embodiments of this invention explicitly include all combinations and sub-combinations of all features, elements and limitation of all claims. Embodiments of this invention explicitly include all combinations and sub-combinations of all features, elements, examples, embodiments, tables, values, ranges, and drawings in the specification and drawings. Embodiments of this invention explicitly include devices and systems to implement any combination of all methods described in the claims, specification and drawings. Embodiments of the methods of invention explicitly include all combinations of dependent method claim steps, in any functional order. Embodiments of the methods of invention explicitly include, when referencing any device claim, a substation thereof to any and all other device claims, including all combinations of elements in device claims.

We claim:

1. An air seal for use between a first, fixed doorway and a second, movable doorway comprising:

wherein the first doorway comprises an inside face and an opposing outside face; wherein the second doorway comprises an inside face and an opposing outside face; wherein the outside face of the first doorway faces the outside face of the second doorway;

a first membrane removably attached on a face of the first doorway blocking airflow through the first doorway;

a second membrane removably attached on a face of the second doorway blocking airflow through the second doorway;

a pliable annulus removably placed between the outside of the first doorway and the outside of the second doorway, creating an airtight inter-doorway volume, the volume surrounded in part by the pliable annulus and both membranes;

a first fluid vent and operable first valve between the inter-doorway volume and free air.

2. The air seal of claim 1 wherein access to the first membrane for attachment is from an air volume in contact with the inside face of the first doorway.

3. The air seal of claim 1 wherein access to the second membrane for attachment is from an air volume in contact with the outside face of the second doorway.

4. The air seal of claim 1 wherein the pliable annulus is inflatable.

5. The air seal of claim 1 wherein the pliable annulus is a baffle.

6. The air seal of claim 1 further comprising one or more mechanical retainers, wherein each of the one or more mechanical retainer permits relative motion between the first doorway and the second doorway within a distance greater than a first preset distance and less than a second preset distance; and wherein each of the one or more mechanical retainer limits relative motion between the first doorway and the second doorway less than the first preset distance and limits relative motion between the first doorway and the second doorway greater than the second preset distance.

7. The air seal of claim 1 wherein the membranes are single-use or limited use.

8. The air seal of claim 1 further comprising a second fluid vent and operable second valve between the inter-doorway volume and outside the inter-doorway volume; wherein one fluid vent accepts sterilizing fluid and the other fluid vent is an exhaust vent.

9. The air seal of claim 1 further comprising a first membrane support surface permanently attached to a perimeter of the first doorway wherein the first membrane is attached to the first membrane support surface.

10. The air seal of claim 1 further comprising a second membrane support surface permanently attached to a perimeter of the second doorway wherein the second membrane is attached to the second membrane support surface.

11. The air seal of claim 1 further comprising:

a sterile first building or module comprising the first doorway;

a sterile, mobile second building or module comprising the second doorway.

12. The air seal of claim 1, wherein:

the air seal is between two modules of a modular vivarium.

13. The air seal of claim 1 wherein the two doorways, two membranes, and annulus create four air volumes isolated from each other: air on the inside of the first doorway and first membrane, air on the inside of the second doorway and second membrane, air in the inter-doorway gap, and ambient air.

14. A method of providing a sterile, airtight fitting between a first, fixed doorway and a second, movable doorway comprising the steps of:

(a) applying a first removable membrane to a first doorway, sealing the doorway;

(b) applying a second removable membrane to a movable second doorway, sealing the second doorway;

(c) placing removably a pliable annulus between the first and second doorway;

(d) moving the second doorway so that the pliable annulus is compressed, forming an airtight seal against both doorways, creating a sealed inter-doorway volume;

(e) using a sterilizing fluid, gas, aerosol or liquid to sterilize the inter-doorway volume;

(f) removing the first membrane;

(g) removing the second membrane;

wherein air may flow freely through both doorways and the inter-doorway volume.

15. The method of claim 14, wherein:

the first doorway is in a vivarium, and the second doorway is in a vivarium module.

* * * * *